US005092401A

United States Patent [19]

Heynen

[11] Patent Number: 5,092,401

[45] Date of Patent: Mar. 3, 1992

[54] WELLHEAD ASSEMBLY

[75] Inventor: Wilhelmus H. P. M. Heynen, Assen, Netherlands

[73] Assignee: Shell Oil Company, Houston, Tex.

[21] Appl. No.: 569,135

[22] Filed: Aug. 17, 1990

[30] Foreign Application Priority Data

Aug. 17, 1989 [GB] United Kingdom ..... 8918844

[51] Int. Cl.[5] ..... E21B 33/047

[52] U.S. Cl. ..... 166/89; 166/208; 166/382; 285/133.2

[58] Field of Search ..... 166/89, 208, 242, 382, 166/115; 285/133.2

[56] References Cited

U.S. PATENT DOCUMENTS

| | | | |
|---|---|---|---|
| 2,118,094 | 5/1938 | McDonongh et al. | 166/89 X |
| 2,157,496 | 5/1939 | Penick et al. | 166/89 X |
| 3,087,547 | 4/1963 | Raulins et al. | 166/89 |
| 3,543,847 | 12/1970 | Haeber | 166/208 X |
| 3,548,934 | 12/1970 | Hutchinson | 166/89 |
| 3,920,071 | 11/1975 | Cegielski | 166/208 X |
| 4,223,738 | 9/1980 | Bouter et al. | 166/89 X |
| 4,842,307 | 6/1989 | Sweeney et al. | 285/133.2 X |
| 4,886,121 | 12/1989 | Demny et al. | 166/208 X |
| 4,900,041 | 2/1990 | Hopkins et al. | 166/115 X |

FOREIGN PATENT DOCUMENTS 2004932 4/1979 United Kingdom .

*Primary Examiner*—Hoang C. Dang

[57] ABSTRACT

A wellhead assembly comprising housing (1), an outer casing hanger (20) and at least one inner casing hanger (22,24) for suspending casings concentrically into a well. Each casing hanger (20,22,24) is provided with an external supporting shoulder (26,40,60), the external supporting shoulder (26) of said outer casing hanger (20) being supported by an internal shoulder (11) formed on the central bore (9) of the housing (1), the external supporting shoulder (40,60) of each inner casing hanger (22,24) being supported by an internal shoulder (28,42) formed on the inner surface of a surrounding casing hanger. Annular space (32,46,64) formed around the upper end of each casing hanger (20,22,24) are sealed with a metal-to-metal seal (76, 78, 79) or with an annular central member (104).

19 Claims, 3 Drawing Sheets

WELLHEAD ASSEMBLY

BACKGROUND OF THE INVENTION

The invention relates to a wellhead assembly for suspending casing strings concentrically into a well such as an oil well or a gas well.

A well comprises a borehole drilled from surface to an underground formation layer from which oil and/or gas is produced. Such a well is cased to prevent collapse of the borehole. A well is started with a relatively large hole which is cased as soon as possible with a so-called surface casing or conductor which is cemented in the borehole. The well is then continued with a smaller hole drilled to an intermediate depth; this hole is cased by an intermediate casing which extends to surface. The upper end of the intermediate casing extends concentrically through the conductor and at least part of the intermediate casing is cemented in the borehole. The well is then continued with again a smaller hole drilled to the production zone; this hole is cased by the production casing which extends to surface. The upper end of the production casing extends concentrically through the intermediate casing and at least part of the production casing is cemented in the borehole.

The upper ends of the intermediate casing and the production casing are suspended from a wellhead assembly which is supported on the surface casing.

A conventional wellhead assembly comprises a housing supported on the surface casing. The housing is provided with a central bore which is provided with internal support shoulders. The wellhead assembly further includes casing hangers for suspending the intermediate casing and the production casing from the internal support shoulders in the housing, and sealing means for sealing off the annular spaces around the casing hangers.

Access to the sealing means may be required, for example if leakage from an annular space occurs. A major problem with this kind of wellhead is that the sealing elements cannot be accessed without cutting one or more casings.

SUMMARY OF THE INVENTION

It is an object of the present invention to provide a wellhead assembly which can be serviced in a non-destructive manner, and of which the seal locations can be accessed without cutting any casings string.

To this end the wellhead assembly according to the invention comprises a normally vertical housing, provided a with central bore, with an inwardly projecting supporting shoulder and with means for securing the housing to a surface casing, two or more casing hangers arranged concentrically in the central bore of the housing, the outermost casing hanger being suspended from the inwardly projecting supporting shoulder of the housing, and annular sealing means preventing fluid communication between the annular space around a casing hanger and the central bore, wherein each casing hanger except the innermost one is provided with an inwardly projecting supporting shoulder from which the adjacent smaller casing hanger is suspended, wherein the upper end of a smaller casing hanger extends further in the central bore than the upper end of a larger casing hanger, wherein the outer diameter of the upper end of a smaller casing hanger is smaller than the inner diameter of the upper end of a larger casing hanger, and wherein the annular sealing means are arranged between the upper end of each casing hanger and the wall of the central bore.

The arrangement of the annular sealing means above the shoulders allows the locations of the sealing means to be accessed without removal of the casing hanger. When the housing has a cylindrical shape and a blowout preventer is installed on top of the housing the annular sealing means can be further removed through the blowout preventer, which operation is accomplished under full pressure control of the blowout preventer.

Advantageously the housing comprises a tubular lower part and a tubular upper part, said parts being detachably connected to each other, wherein the lower part is provided with inwardly projecting supporting shoulder, and wherein the annular sealing means are located in the upper part.

In case a complete overhaul of the wellhead assembly is required, the annular sealing means are first removed through the central bore in the top of the tubular upper part of the housing, whereafter the annular spaces around the hanger elements are capped, and subsequently the tubular upper part is lifted from the lower part. It may also be required to replace the tubular upper part. If for example the well pressure has decreased or increased during the lifetime of the well, the tubular upper part can be replaced by a tubular upper part designed for lower or higher pressures.

BRIEF DESCRIPTION OF THE DRAWINGS

The invention will now be described by way of example with reference to the accompanying drawings, in which.

DESCRIPTION OF THE PREFERRED EMBODIMENT

Figure 1:
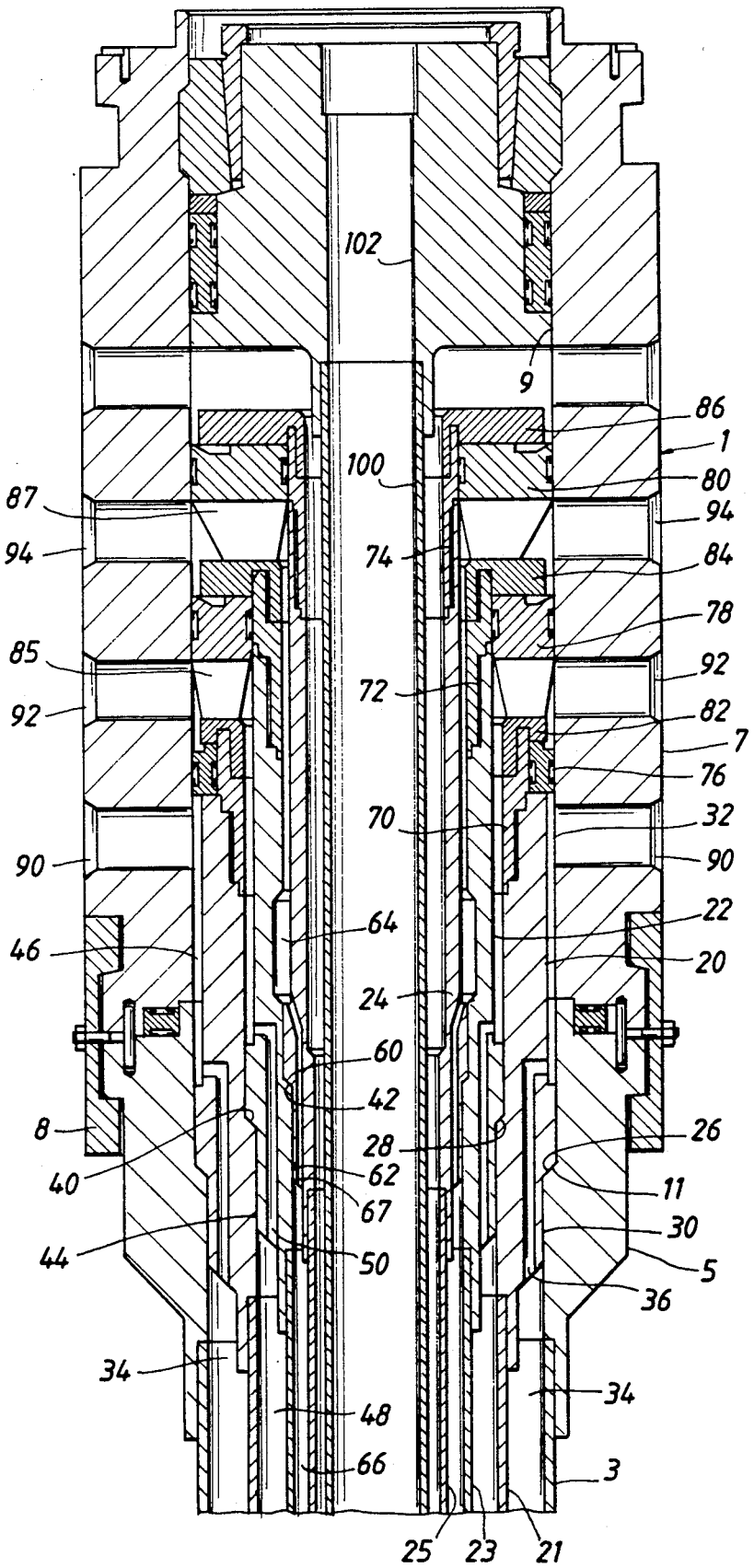
FIG. 1 shows schematically a longitudinal section of the wellhead assembly according to the invention.
Figure 2:
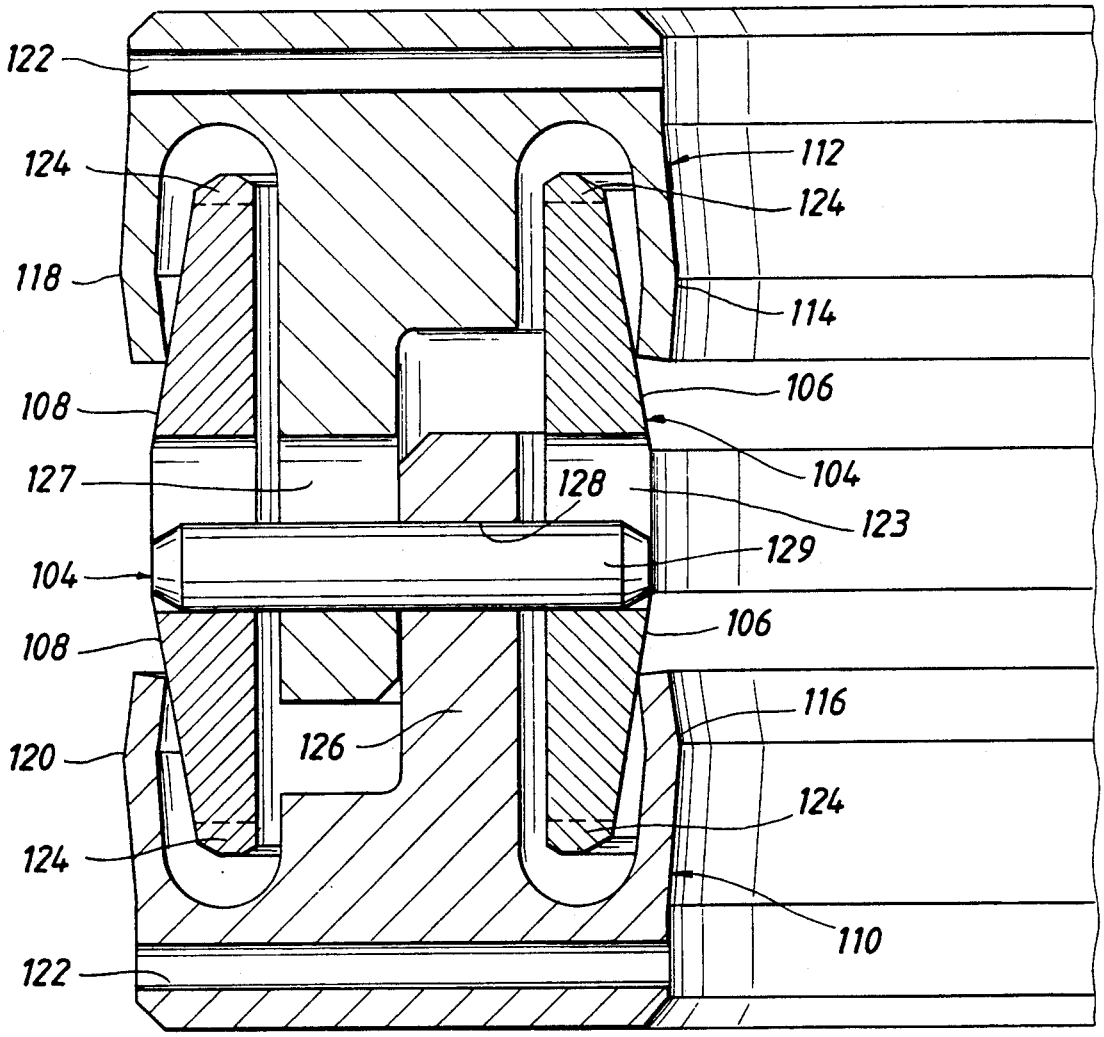
FIG. 2 shows schematically part of a cross-section of an annular sealing means for the wellhead assembly of FIG. 1 drawn to a scale larger than the scale of FIG. 1.
Figure 3:
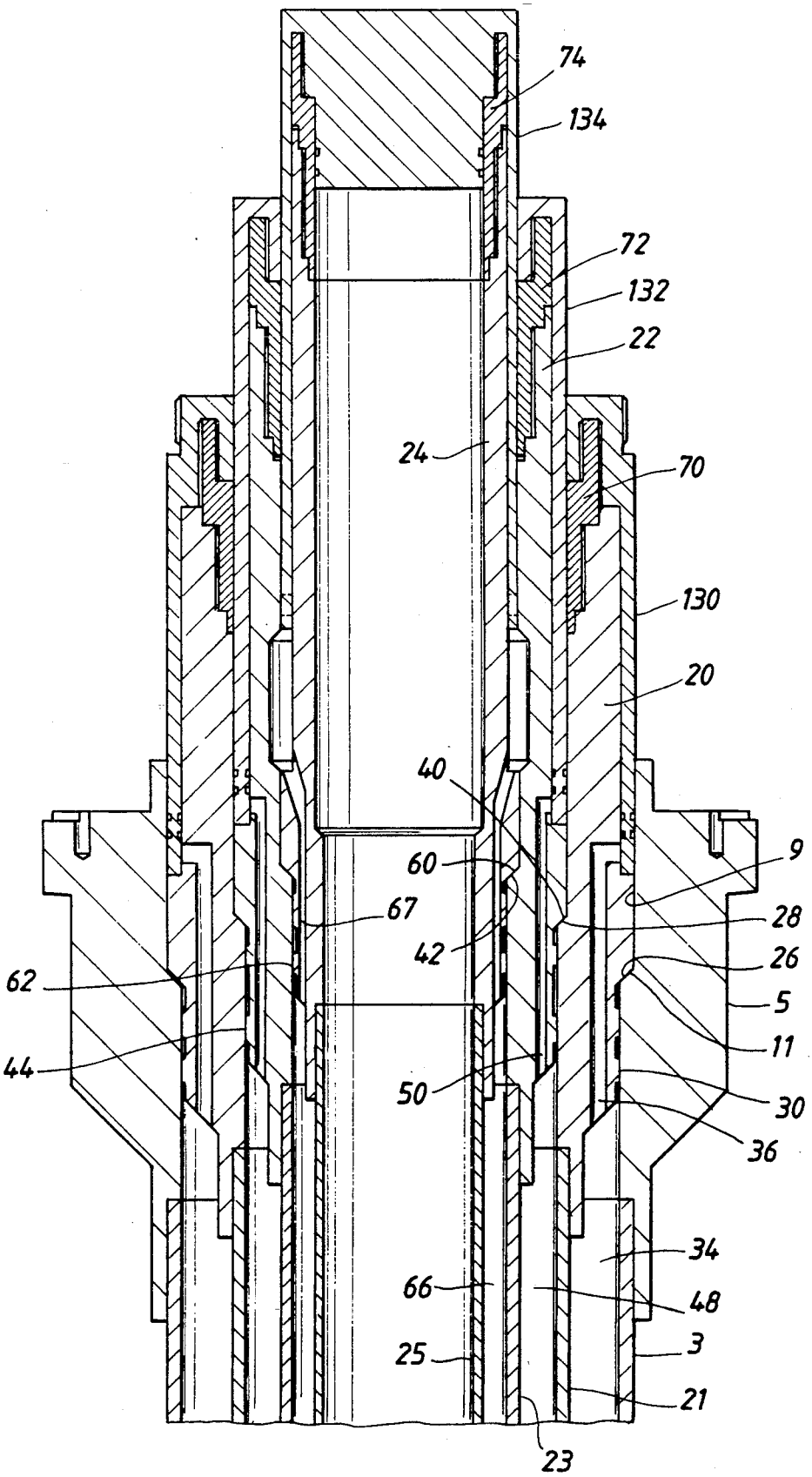
FIG. 3 shows schematically a longitudinal section of the wellhead assembly of FIG. 1 in a disassembled state.

The wellhead assembly depicted in FIGS. 1–3 comprises a housing 1 which is supported at its lower end on a surface casing 3. The surface casing 3 is cemented in a borehole (not shown). The housing 1 includes a tubular lower part 5 resting on the surface casing 3 and a tubular upper part 7 which is open at its upper end. The tubular lower part 5 and the tubular upper part 7 are detachably interconnected by means of clamp 8. The housing 1 has a central bore 9 extending through both the tubular lower part 5 and the tubular upper part 7.

A blowout preventer (not shown) can be connected to the upper end of the tubular upper part 7 of the housing 1. A blowout preventer is an assembly with a central bore through which tubulars can be lowered into the well which assembly is provided with rams for closing off the central bore to prevent uncontrolled fluid flow-outs of the well. Suitably the blowout preventer is so selected that the diameter of its central bore corresponds to the diameter of the central bore 9.

An inwardly projecting supporting shoulder 11 is arranged in the central bore 9, which shoulder 11 has an annular shape and extends along the inner circumference of the tubular lower part 5 of the housing 1.

The wellhead assembly comprises three casing hangers 20, 22 and 24 which are arranged concentrically in the central bore 9 of the housing 1. The outermost casing hanger 20 is larger than the casing hanger 22 which in its turn is larger than the innermost casing hanger 24. The upper end of the innermost casing hanger 24 extends further into the central bore 9, than the upper end of larger casing hanger 22, of which the upper end extends further in the central bore 9 than that of the outermost, largest casing hanger 20. Outer intermediate casing 21 is suspended from the outermost casing hanger 20, inner intermediate casing 23 is suspended from casing hanger 22 and production casing 25 is suspended from the innermost casing hanger 24.

The outermost casing hanger 20 is provided with an outwardly projecting shoulder 26 extending along the outer circumference of the outermost casing hanger 20, and an inwardly projecting supporting shoulder 28 extending along the inner circumference of the outermost casing hanger 20 and arranged above the outwardly projecting shoulder 26. The outwardly projecting shoulder 26 is supported by the inwardly projecting supporting shoulder 11 of the housing 1. A guiding section 30 is provided in the outermost casing hanger element 20 below its outwardly projecting shoulder 26. The external diameter of the guiding section 30 corresponds to the inner diameter of the inwardly projecting supporting shoulder 11 of the tubular lower part 5 so as to centralize the outermost casing hanger 20. An outer annular space 32 is formed between the outer most casing hanger 20 and the wall of the central bore 9 in the housing 1, which outer annular space 32 is in communication with an annulus 34 around the outer intermediate casing 21 suspended from the outermost casing hanger 20 via a bore 36 in said outermost casing hanger 20.

Casing hanger 22 is provided with an outwardly projecting shoulder 40 extending along the outer circumference of the casing hanger 22, and an inwardly projecting supporting shoulder 42 extending along the inner circumference of the casing hanger 22 and arranged above the outwardly projecting shoulder 40. The outwardly projecting shoulder 40 is supported by the inwardly projecting supporting shoulder 28 of the outermost casing hanger 20. A guiding section 44 is provided in the casing hanger 22 below its outwardly projecting shoulder 40, which guiding section 44 has an external diameter corresponding to the inner diameter of the inwardly projecting shoulder 28 of the outermost casing hanger 20 so as to centralize the casing hanger 22. A first inner annular space 46 is formed between the casing hanger 22 and the inner surface of the outermost casing hanger 20, which first inner annular space 46 is in communication with an annulus 48 around the inner intermediate casing 23 suspended from the casing hanger 22 via a bore 50 in the casing hanger 22.

Innermost casing hanger 24 is provided with an outwardly projecting shoulder 60 extending along the outer circumference of the innermost casing hanger 24. The outwardly projecting shoulder 60 is supported by the inwardly projecting support shoulder 42 of the casing hanger 22. A guiding section 62 is provided in the innermost casing hanger 24 below outwardly projecting shoulder 60, which guiding section 62 has an external diameter corresponding to the inner diameter of the internal inwardly projecting support shoulder 42 so as to centralize the second inner hanger element 24 in the casing hanger 22. A second inner annular space 64 is formed between the innermost casing hanger 24 and the inner surface of the casing hanger 22, which second inner annular space 64 is in communication with an annulus 66 around the production casing 25 suspended from said innermost casing hanger 24 via a bore 67 in the innermost casing hanger 24.

The upper end of the innermost casing hanger 24 extends further in the central bore 9 of the housing 1 than the upper end of the larger casing hanger 22, and the upper end of the casing hanger 22 in its turn extends further in the central bore 9 than the upper end of the larger outermost casing hanger 20. The outer diameter of the upper end of the innermost casing hanger 24 is smaller than the inner diameter of the upper end of the larger casing hanger 22, and the outer diameter of the upper end of the casing hanger 22 is smaller than the inner diameter of the upper end of the larger outermost casing hanger 20.

Each hanger element 20,22,24 is at its upper end provided with an annular member 70,72,74 having a sealing surface cooperating with a pressure activateable metal to metal annular sealing means 76,78,80 arranged between the upper end of each casing hanger 20, 22 and 24 and the wall of the central bore 9 in the housing 1, so as to seal the annular spaces 32,46,64 around the casing hangers 20,22,24. Each annular member 70,72,74 is at its upper end provided with locking means for locking the annular sealing means 76,78,80 which cooperates with said annular member 70,72,74 in vertical direction, each locking means being formed as a lock down nut 82,84,86. Annular sealing means 80 rests on a support ring 87 provided with passages which support ring rests in lock down nut 84. Annular sealing means 78 rests on support ring 85 provided with passages which support ring rests in lock down nut 82.

The advantage of the wellhead assembly according to the present invention is that if annular sealing means 80 has been removed, one can unscrew easily the lock down nut 84 and remove the annular sealing means 18. Thereafter, the lock down nut 82 can be unscrewed and the annular sealing means 76 can be removed.

The tubular upper part 7 is provided with outlet openings 90,92,94 which are in communication with an annular space 32,46,64, respectively. In the outlet openings 90,92,94 external valves (not shown) can be fitted. Through the outlet openings drilling fluid can pass which is displaced by cement pumped into the well to fill the annular space around a casing. The tubular upper part 7 is further provided with bores (not shown) for pressure testing the annular sealing means 76,78,80. Each of these bores is in communication with an annular sealing means 76,78,80 and is provided with means for connecting an external pressure gauge (not shown).

A tubing 100 extends into the well, which tubing 100 is suspended from a tubing hanger 102 supported in the upper end of the housing 1.

FIG. 2 shows the left side of the cross-section of an annular sealing means that can replace any one of the annular sealing means 76, 78 or 80. The seal includes an annular central member 104 having a tapering inner surface in the form of inner annular wedge 106, a tapering outer surface in the form of outer annular wedge 108, a lower sealing ring 110 and an upper sealing ring 112.

The upper sealing ring 112 is provided with an inner sealing lip 114 and an outer sealing lip 118, and the lower sealing ring 110 is provided with inner sealing lip 116 and with outer sealing lip 120. The sealing lips 112,116,118 and 120 extend along the circumference of the sealing means. When installed, the lower sealing ring 110 rests on a support (e.g. a support ring 85 or 87 in FIG. 1), the upper sealing ring 112 is pressed downwards by a lock down nut (for example nut 86 or 84 in FIG. 1), the outer seal lips 118 and 120 are arranged against the wall of the bore 9 (see FIG. 1) and the inner sealing lips 112 and 116 are arranged against an upper end of a casing hanger.

The sealing lips are forced to displace in radial direction by the annular wedge 106 and 108 as the upper seal ring 112 is forced downwards.

To avoid trapping of fluid, the seal rings 110 and 112 have been provided with bores 122 and the wedges with passages 123.

The upper sealing ring 112 and the lower sealing ring 110 have m-shaped cross-sections wherein the open sides face each other. The ringshaped middle legs 125 and 126 can slide along each other, these legs are provided with a plurality of openings 127 and 128, the openings are distributed at regular intervals along the circumference of the middle legs 125 and 126 and the openings face each other. A pin 129 can be inserted through some of the facing openings 127 and 128. In this case one of the openings is elongated in axial direction so as to define the axial displacement of the upper sealing ring 112 relative to the lower sealing ring 110 (in FIG. 2 opening 127 is the elongated opening).

Through the openings without a pin, fluid communication is possible and this enables pressure testing the seal by the inner sealing lips 114 and 116 and the outer sealing lips 118 and 120.

As shown in FIG. 3 an outer cap 130, a first inner cap 132 and a second inner cap 134 are mounted to the annular members 70,72,74 when the tubular upper part 7 and the annular sealing means 76,78,80 are to be removed from the wellhead assembly. The outer cap 130 extends into the outer annular space 32 around the outer hanger element 20 and is sealed in the annular space 32, the first inner cap 132 extends into the first inner annular space 46 around the first inner hanger element 22 and is sealed in the annular space 46, and the second inner cap 134 extends into the second inner annular space 64 around the second inner hanger element 24 and is sealed in the annular space 64.

During normal use of the wellhead assembly with reference to FIGS. 1-3, the annuli 34,48,66 around the inner casings are filled with cement and the external valves located the outlet openings 90,92,94 in the tubular upper part 7 are closed. Gas which may enter into said annuli 34,48,66 may migrate through the cement in said annuli 34,48,66 and enter the annular spaces 32,46,64 around the casing hangers 20,22,24 via the bores 36,50,67 in the casing hangers 20,22,24. The annular spaces 32,46,64 are sealed by the annular sealing means 76,78,80 in order to confirm the gas in the annular spaces 32,46,64.

If disassembling of the wellhead assembly is required, for example to replace the annular sealing means 76,78,80 and the annular face members 70,72,74, a blowout preventer (not shown) is mounted on top of the tubular upper part 7. The blowout preventer (BOP) has a central bore which has the same diameter as the central bore 9 of the housing 1. The BOP is opened and the tubing 100 and the tubing hanger 102 are removed through the BOP. Subsequently the uppermost lock down nut 86 is removed through the BOP, thereby providing access to the uppermost annular sealing means 80, annular member 74 and support ring 87, which are removed through the BOP. Subsequently the next lower lock down nut 84 is removed through the BOP, thereby providing access to the next lower annular sealing means 78, annular member 72 and support ring 85, which are removed through the BOP. Subsequently the lowemost lock down nut 82 is removed through the BOP, thereby providing access to the lowermost annular sealing means 76 and annular member 70, which are removed through the BOP. Assembling of the well head asembly occurs in a reversed order.

Since the BOP does not have to be removed during assembling and disassembling of the well head assembly, said assembling and said disassembling can occur under BOP pressure control.

If removal of the tubular upper part 7 is required, for example to replace a high pressure upper part by a low pressure upper part or vice versa, the annular sealing means 76,78,80 are first removed as described herienbefore. Subsequently caps 130,132,134 are inserted through the BOP and mounted to the annular members 70,72,74. With the caps 130,132,134 installed the tubular upper part 7 is removed from the tubular lower part 5. Installation of the tubular upper part 7 occurs in a reversed order.

I claim:

1. A wellhead assembly comprising a normally vertical housing provided with a central bore, with an inwardly projecting supporting shoulder, and with means for securing the housing to a surface casing, two or more casing hangers arranged concentrically in the central bore of the housing, the outermost casing hanger being suspended from the inwardly projecting supporting shoulder of the housing, and annular sealing means preventing fluid communication between an annular space around a casing hanger and a central bore, wherein each casing hanger except the innermost one is provided with an inwardly projecting supporting shoulder from which the adjacent smaller casing hanger is suspended, wherein the uppermost end of a smaller casing hanger extends further in the central bore than the uppermost end of a larger casing hanger, wherein the outer diameter of the uppermost end of a smaller casing hanger is smaller than the inner diameter of the uppermost end of a larger casing hanger, and wherein the annular sealing means are arranged between the upper end of each casing hanger and the wall of the central bore.

2. The wellhead assembly of claim 1, wherein the housing comprises a tubular lower part and a tubular upper part, said parts being detachably connected to each other, wherein the lower part is provided with the inwardly projecting supporting shoulder, and wherein the annular sealing means of each casing hanger is located in the upper part.

3. The wellhead assembly of claim 1 wherein each casing hanger further includes an annular member having a sealing surface cooperating with the annular sealing means.

4. The wellhead assembly of claim 3, wherein each annular member is provided with locking means for locking the annular sealing means in vertical direction.

5. The wellhead assembly of any of one of claims 1–4, wherein the annular sealing means comprises an annular central member having a tapering inner surface and a tapering outer surface, an upper sealing ring and a lower sealing ring, each sealing ring being provided with an inner sealing lip in contact with said tapering inner surface and an outer sealing lip in contact with said tapering outer surface, so as to move the inner sealing lip inward and the outer sealing lip outward upon axial compression of the central member.

6. The wellhead assembly of any one of claims 1–4, wherein each casing hanger is provided with an outwardly projecting shoulder cooperating with an inwardly projecting supporting shoulder of the adjacent larger casing hanger.

7. The wellhead assembly of claim 6, wherein for a casing hanger the inwardly projecting supporting shoulder is arranged above the outwardly projecting shoulder.

8. The wellhead assembly of any one of claims 1–4, wherein each casing hanger is provided with a guiding section below the outwardly projecting shoulder.

9. The wellhead assembly of any one of claims 1–4, wherein each casing hanger is provided with a bore which is in communication with an annular space around the casing hanger and with an annulus between a casing string suspended from the casing hanger and a surrounding casing string.

10. A wellhead assembly comprising:

a normally vertical housing having a central bore, an inwardly projecting supporting shoulder, and means for securing the housing to a surface casing;

two or more casing hangers arranged concentrically in the central bore of the housing, the outermost casing hanger being suspended from the inwardly projecting supporting shoulder of the housing, each casing hanger except the innermost one having an inwardly projecting supporting shoulder from which the adjacent next smaller casing hanger is suspended, the uppermost end of the smaller casing hanger extends further in the central bore than the uppermost end of a larger casing hanger, and the outer diameter of the uppermost end of the smaller casing hanger is smaller than the inner diameter of the uppermost end of the larger casing hanger; and annular sealing means between the upper end of each casing hanger and the wall of the central bore for preventing fluid communication between an annular space around a casing hanger and the central bore.

11. The wellhead assembly of claim 10, wherein the housing comprises:

a tubular lower part;

a tubular upper part detachably connected to the tubular lower part; and wherein the lower part is provided with the inwardly projecting supporting shoulder and the annular sealing means is located in the upper part.

12. The wellhead assembly of claim 11, wherein each casing hanger further includes an annular member having a sealing surface cooperating with the annular sealing means.

13. The wellhead assembly of claim 12, wherein each annular member is provided with locking means for locking the annular sealing means in vertical direction.

14. The wellhead assembly of claim 13, wherein the annular sealing means comprises:

an annular central member having a tapering inner surface and a tapering outer surface;

an upper sealing ring displaceable toward the central member;

a lowe sealing ring displaceable toward the central member;

a lower sealing lip on each of the upper and lower sealing rings in contact with said tapering inner surface; and an outer sealing lip on each of the upper and lower sealing rings in contact with said tapering outer surface;

whereby, upon axial compression of the annular sealing means, the inner sealing lip moves inward and the outer sealing lip moves outward.

15. The wellhead assembly of claim 14, wherein each casing hanger is provided with an outwardly projecting shoulder cooperating with an inwardly projecting supporting shoulder of the adjacent larger casing hanger.

16. The wellhead assembly of claim 15, wherein for a casing hanger the inwardly projecting supporting shoulder is arranged above the outwardly projecting shoulder.

17. The wellhead assembly of claim 16, wherein each casing hanger further comprises a guiding section below the outwardly projecting shoulder.

18. The wellhead assembly of claim 17, wherein each casing hanger is provided with a bore which is in communication with the annular space around the casing hanger and with an annulus between the casing string suspended from the casing hanger and a surrounding casing string.

19. A wellhead assembly comprising:

a normally vertical housing, comprising:

a tubular lower part defining a central bore;

an inwardly projecting supporting shoulder in the tubular lower portion;

a tubular upper part extending the central bore, said tubular upper part being detachably connected to the tubular lower part;

means for securing the housing to a surface casing; and a plurality of casing hangers arranged concentrically in the central bore of the housing, the outermost casing hanger being suspended from the inwardly projected supporting shoulder, and the outermost casing hanger and each succeeding casing hanger to the innermost, comprising:

an inwardly projecting supporting shoulder from which the adjacent next smaller casing hanger is suspended in a manner such that the uppermost end of the smaller casing hanger extends further in the central bore than the uppermost end of a larger casing hanger and the outer diameter of the uppermost end of the smaller casing hanger is smaller than the inner diameter of the uppermost end of the larger casing hanger; and an outwardly projecting shoulder cooperating with the inwardly projecting supporting shoulder.

* * * * *